US011842834B2

(12) United States Patent
Park et al.

(10) Patent No.: US 11,842,834 B2
(45) Date of Patent: Dec. 12, 2023

(54) COIL COMPONENT

(71) Applicant: SAMSUNG ELECTRO-MECHANICS CO., LTD., Suwon-si (KR)

(72) Inventors: Kwang Il Park, Suwon-si (KR); Young Sun Kim, Suwon-si (KR); Jong Min Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 469 days.

(21) Appl. No.: 16/863,364

(22) Filed: Apr. 30, 2020

(65) Prior Publication Data

US 2021/0183558 A1 Jun. 17, 2021

(30) Foreign Application Priority Data

Dec. 12, 2019 (KR) ..... 10-2019-0165360

(51) Int. Cl.

| | |
|---|---|
| ***H01F 17/00*** | (2006.01) |
| ***H01F 17/04*** | (2006.01) |
| ***H01F 27/255*** | (2006.01) |
| ***H01F 27/32*** | (2006.01) |

(52) U.S. Cl.

CPC ..... *H01F 17/0013* (2013.01); *H01F 17/04* (2013.01); *H01F 27/255* (2013.01); *H01F 27/32* (2013.01); *H01F 2017/048* (2013.01)

(58) Field of Classification Search

CPC .... H01F 17/0013; H01F 17/04; H01F 27/255; H01F 27/32; H01F 2017/048

See application file for complete search history.

(56) References Cited

U.S. PATENT DOCUMENTS

| | | | | |
|---|---|---|---|---|
| 9,775,232 | B2 * | 9/2017 | Park | H01G 4/1227 |
| 2005/0128042 | A1 | 6/2005 | Tomohiro et al. | |
| 2014/0009254 | A1 * | 1/2014 | Ohkubo | H01F 17/0033 336/192 |

(Continued)

FOREIGN PATENT DOCUMENTS

| | | | |
|---|---|---|---|
| CN | 1627456 | A | 6/2005 |
| CN | 103650081 | A | 3/2014 |

(Continued)

OTHER PUBLICATIONS

Korean Office Action dated Oct. 21, 2020 issued in Korean Patent Application No. 10-2019-0165360 (with English translation).

Chinese Office Action dated Aug. 3, 2022, issued in corresponding Chinese Patent Application No. 202010650103.8.

(Continued)

*Primary Examiner* — Michael P McFadden

(74) *Attorney, Agent, or Firm* — Morgan, Lewis & Bockius LLP

(57) ABSTRACT

A coil component includes a body, a support substrate embedded in the body and having one end surface exposed to an external surface of the body, a coil portion disposed on the support substrate to be embedded in the body and having one end portion exposed to the external surface of the body together with the one end surface of the support substrate, and an external electrode disposed on the external surface of the body to be connected to the one end portion of the coil portion. The external electrode has an opening exposing at least a portion of the one end surface of the support substrate.

15 Claims, 7 Drawing Sheets

(56) References Cited

U.S. PATENT DOCUMENTS

| | | | | |
|---|---|---|---|---|
| 2014/0176284 | A1 | 6/2014 | Lee et al. | |
| 2014/0252693 | A1 | 9/2014 | Fujita et al. | |
| 2014/0268488 | A1 | 9/2014 | Hattori et al. | |
| 2015/0042440 | A1 | 2/2015 | Tsurumi et al. | |
| 2015/0371781 | A1 | 12/2015 | Choi et al. | |
| 2016/0042857 | A1 | 2/2016 | Chun et al. | |
| 2016/0225517 | A1* | 8/2016 | Choi | H01F 17/0013 |
| 2016/0268038 | A1* | 9/2016 | Choi | H01F 27/255 |
| 2016/0351332 | A1* | 12/2016 | Lee | H01G 4/232 |
| 2017/0032883 | A1* | 2/2017 | Hong | H01F 41/046 |
| 2017/0309389 | A1* | 10/2017 | Sato | H01F 41/041 |
| 2018/0082793 | A1 | 3/2018 | Satoh et al. | |
| 2018/0096783 | A1* | 4/2018 | Fukuda | H01F 27/366 |
| 2018/0174753 | A1* | 6/2018 | Terashita | H01G 4/008 |
| 2018/0268990 | A1* | 9/2018 | Lee | H01F 27/29 |
| 2018/0337001 | A1 | 11/2018 | Tozawa et al. | |
| 2019/0027288 | A1* | 1/2019 | Sato | H01F 5/04 |
| 2019/0066908 | A1 | 2/2019 | Ueda et al. | |

FOREIGN PATENT DOCUMENTS

| | | | |
|---|---|---|---|
| CN | 103765533 | A | 4/2014 |
| CN | 104051153 | A | 9/2014 |
| CN | 105305996 | A | 2/2016 |
| CN | 108109807 | A | 6/2018 |
| CN | 109074947 | A | 12/2018 |
| JP | 2002-313629 | A | 10/2002 |
| JP | 2006-261862 | A | 9/2006 |
| JP | 2007-134398 | A | 5/2007 |
| JP | 2014-127717 | A | 7/2014 |
| KR | 10-1397488 | B1 | 5/2014 |
| KR | 10-2016-0094123 | A | 8/2016 |
| KR | 10-1876878 | B1 | 7/2018 |
| WO | 2012/132726 | A1 | 10/2012 |

OTHER PUBLICATIONS

Chinese Office Action dated Sep. 19, 2023, issued in corresponding Chinese Patent Application No. 202010650103.8.

* cited by examiner

COIL COMPONENT

CROSS-REFERENCE TO RELATED APPLICATION(S)

This application claims the benefit under 35 USC 119 (a) of Korean Patent Application No. 10-2019-0165360 filed on Dec. 12, 2019 in the Korean Intellectual Property Office, the entire disclosure of which is incorporated herein by reference for all purposes.

TECHNICAL FIELD

The present disclosure relates to a coil component.

BACKGROUND

An inductor, a coil component, is a typical passive electronic component used in electronic devices, along with a resistor and a capacitor. Such a component is mounted on a mounting board such as a printed circuit board (PCB), together with other electronic components, and is then provided in an electronic device.

With the recent trend for the miniaturization of electronic devices, the above-mentioned mounting board has been decreased in size. However, with the improvement in performance of electronic devices, the number of electronic components to be mounted on a mounting board is increasing more and more. As a result, a distance between adjacent electronic components, mounted on the mounting board and spaced apart from each other, has been reduced.

An electronic component is electrically connected to the mounting board through a bonding member such as solder or the like. However, for the above-described reason, a thickness of a solder connecting the electronic component to the mounting board needs to be reduced.

SUMMARY

An aspect of the present disclosure is to provide a coil component in which a thickness of a solder fillet connected to an external electrode during mounting of the coil component is reduced to prevent electrical short-circuits between the coil component and another electronic component mounted together on a mounting board, or the like.

According to an aspect of the present disclosure, a coil component includes a body, a support substrate embedded in the body and having one end surface exposed to an external surface of the body, a coil portion disposed on the support substrate to be embedded in the body and having one end portion exposed to the external surface of the body together with the one end surface of the support substrate, and an external electrode disposed on the external surface of the body to be connected to the one end portion of the coil portion. Opening is formed in the external electrode to expose at least a portion of the one end surface of the support substrate.

BRIEF DESCRIPTION OF DRAWINGS

The above and other aspects, features, and advantages of the present disclosure will be more clearly understood from the following detailed description, taken in conjunction with the accompanying drawings.

DETAILED DESCRIPTION

Figure 1:
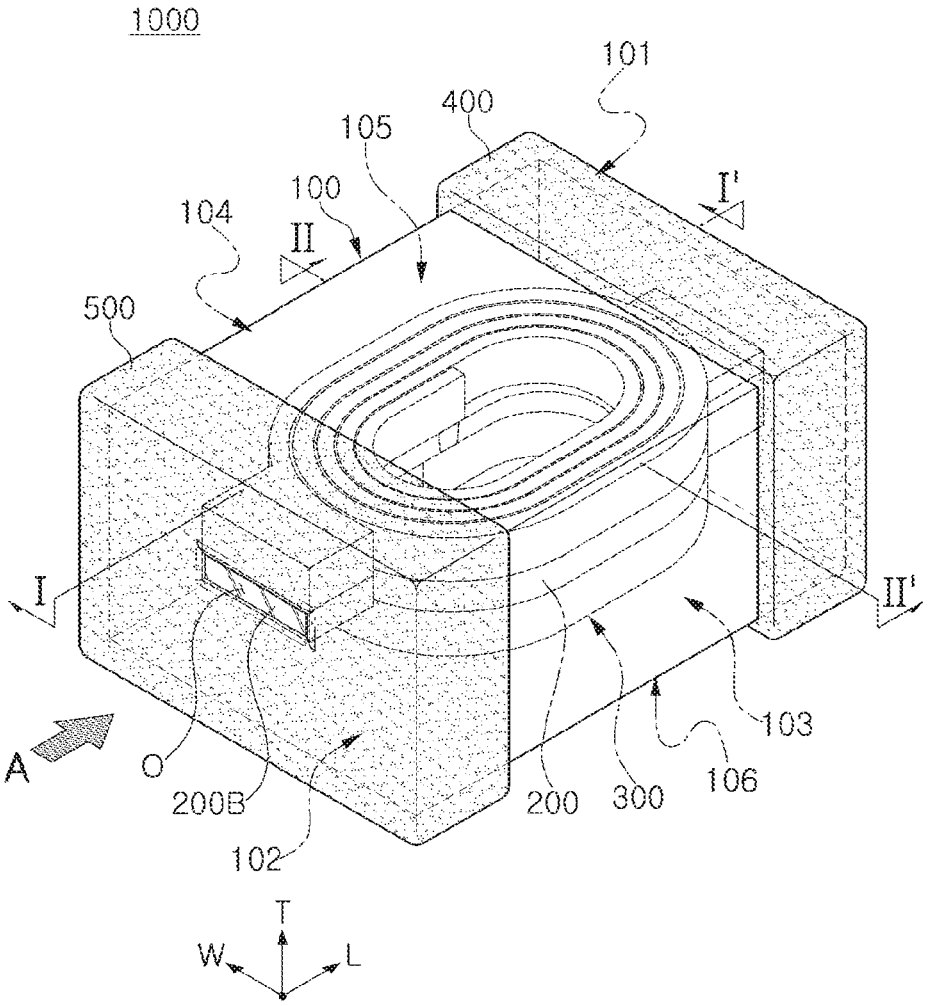
FIG. 1 is a schematic view of a coil component according to an example embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (longitudinal) direction, a W direction is a second direction or a width direction, a T direction is a third direction or a thickness direction.

Hereinafter, a coil component according to an example embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

Example Embodiment and Modified Example

Figure 2:
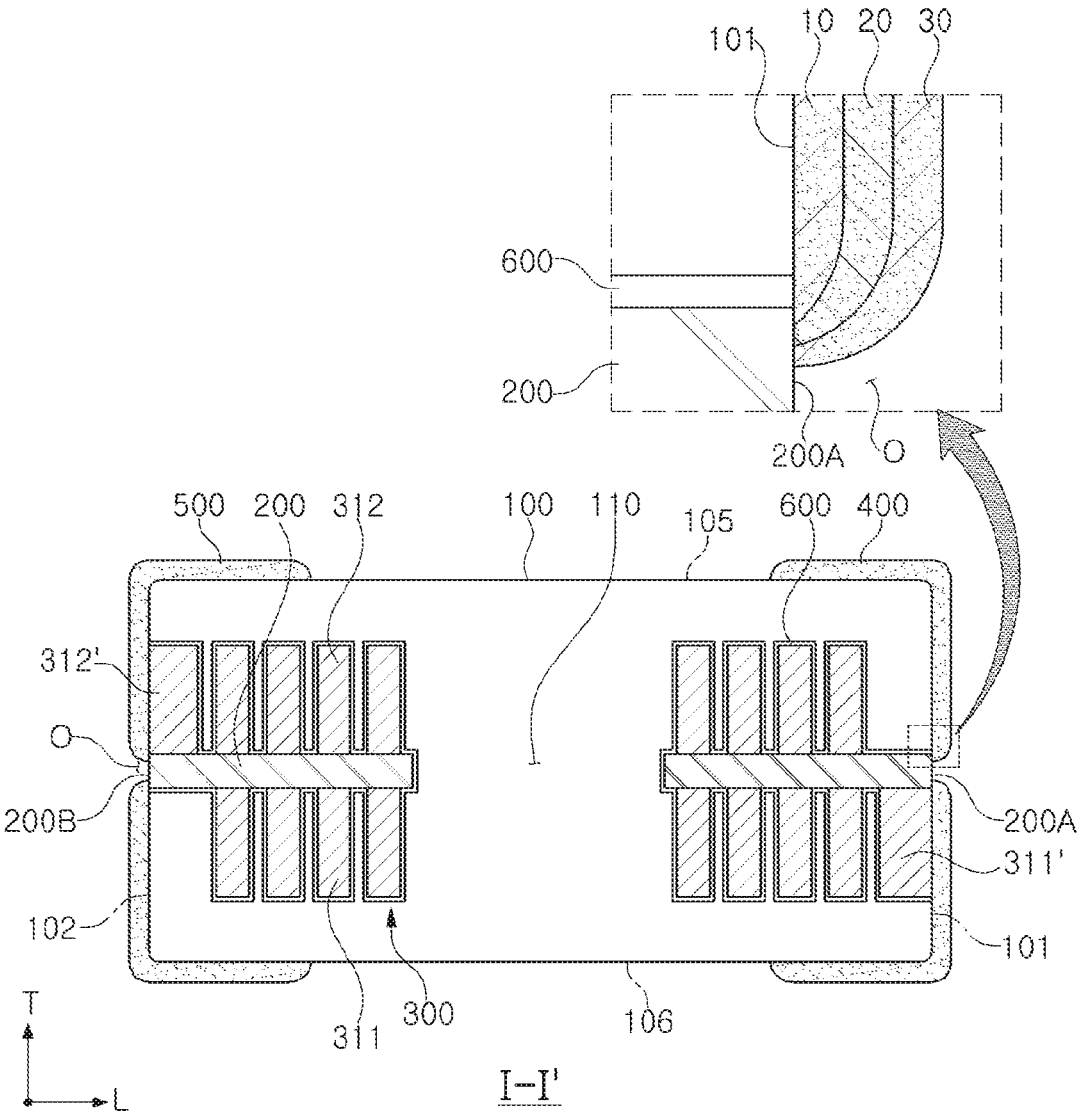
FIG. 2 is a cross-sectional view taken along line I-I' in FIG. 1.

FIG. 1 is a schematic view of a coil component according to an example embodiment of the present disclosure. FIG. 2 is a cross-sectional view taken along line I-I' in FIG. 1. FIG.

Figure 4:
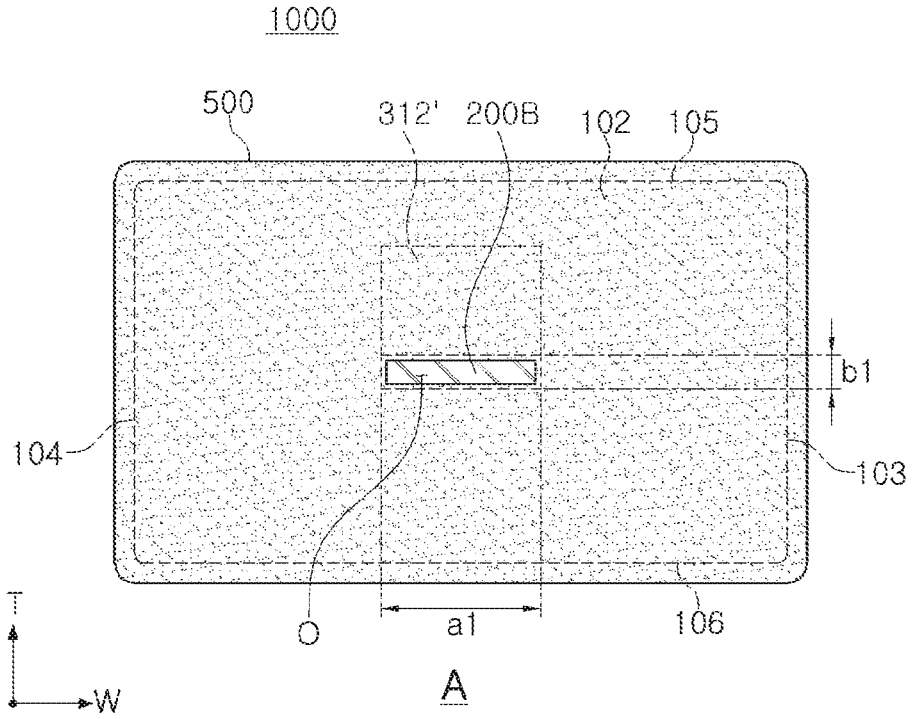
FIG. 4 is a view when viewed in a direction A of FIG. 1.
Figure 5:
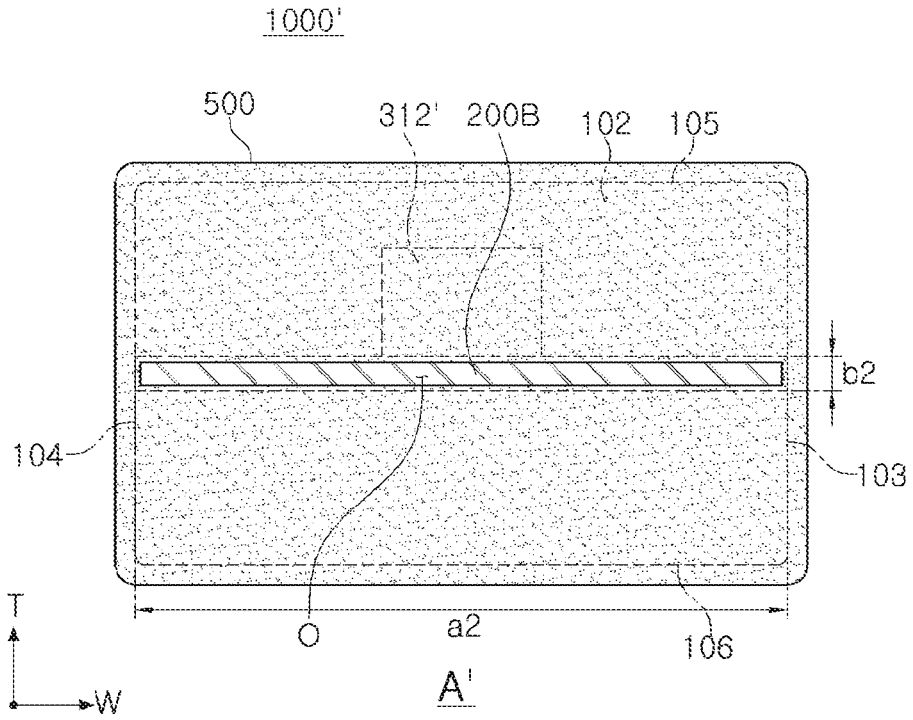
FIG. 5 is a schematic view illustrating a modified example of a coil component according to an example embodiment of the present disclosure, and is a view corresponding to FIG. 4.

3 is a cross-sectional view taken along line II-II' in FIG. 1. FIG. 4 is a view when viewed in a direction A of FIG. 1. FIG. 5 is a schematic view illustrating a modified example of a coil component according to an example embodiment of the present disclosure, and is a view corresponding to FIG. 4.

Referring to FIGS. 1 to 5, a coil component 1000 according to an example embodiment may include a body 100, a support substrate 200, a coil portion 300, and external electrodes 400 and 500, and may further include an insulating layer 600. Openings O are formed in the external electrodes 400 and 500.

The body 100 may form an appearance of the coil component 1000, and may embed the support substrate 200 and the coil portion 300 therein.

As an example, the body 100 may be formed to have a hexahedral shape overall, and may have a total of six external surfaces.

Figure 3:
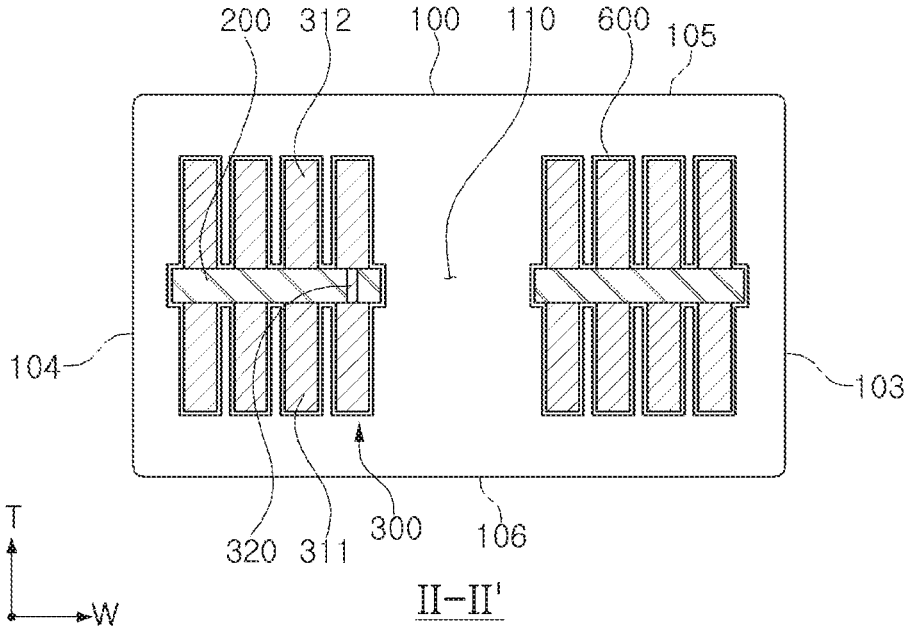
FIG. 3 is a cross-sectional view taken along line II-II' in FIG. 1.

Based on FIGS. 1 to 3, the body 100 has a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. Each of the first to fourth surfaces 101, 102, 103, and 104 of the body 100 may correspond to a wall surface of the body 100 connecting the fifth surface 105 and the sixth surface 106 of the body 100. Hereinafter, both end surfaces of the body 100 may refer to the first surface 101 and the second surface 102 of the body 100, respectively, and both side surfaces of the body 100 may refer to the third surface 103 and the fourth surface 104 of the body 100, respectively. One surface of the body 100 may refer to the sixth surface 106 of the body 100, and the other surface of the body 100 may refer to the fifth surface 105 of the body 100. Further, hereinafter, an upper surface and a lower surface of the body 100 may refer to the fifth surface 105 and the sixth surface 106 of the body 100 determined based on directions of FIGS. 1 to 3, respectively.

The body 100 may be formed such that the coil component 1000, including the external electrodes 400 and 500 to be described later, has a length of 2.0 mm, a width of 1.2 mm, and a thickness of 0.65 mm, but is not limited thereto. Alternatively, the body 100 may be formed such that the coil component 1000, including the external electrodes 400 and 500, has a length of 2.0 mm, a width of 1.6 mm, and a thickness of 0.55 mm. Still alternatively, the body 100 may be formed such that the coil component 1000, including the external electrodes 400 and 500, has a length of 2.0 mm, a width of 1.2 mm, and a thickness of 0.55 mm. Alternatively, the body 100 may be formed such that the coil component 1000, including the external electrodes 400 and 500, has a length of 1.2 mm, a width of 1.0 mm, and a thickness of 0.55 mm. Since the above-described sizes of the coil component 1000 are merely illustrative, cases in which a size of the coil component 1000 are smaller or larger than the above-mentioned dimensions may not be excluded from the scope of the present disclosure.

The body 100 may include magnetic powder particles and an insulating resin. Specifically, the body 100 may be formed by laminating one or more magnetic composite sheets, including an insulating resin and magnetic powder particles dispersed in the insulating resin, and curing the laminated magnetic composite sheets. However, the body 100 may have a structure other than the structure in which the magnetic powder particles are dispersed in the insulating resin. For example, the body 100 may be formed of a magnetic material such as ferrite. For the above-described reason, the body 100 may be regarded as a magnetic body having magnetic properties.

The magnetic powder particles may be, for example, ferrite powder particles or metal magnetic powder particles.

Examples of the ferrite powder particles may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, or Li-based ferrites.

The metal magnetic powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, or a Fe—Cr—Al-based alloy powder.

The metallic magnetic powder particle may be amorphous or crystalline. For example, the metal magnetic powder particle may be a Fe—Si—B—Cr-based amorphous alloy powder, but is not limited thereto.

Each of the ferrite powder particles and the metal magnetic powder particles may have an average diameter of about 0.1 μm to 30 μm, but is not limited thereto.

The body 100 may include two or more types of magnetic powder particles dispersed in an insulating resin. In this case, the term "different types of magnetic powder particle" means that the magnetic powder particles, dispersed in the insulating resin, are distinguished from each other by diameter, composition, crystallinity, and shape. For example, the body 100 may include two or more magnetic powder particles having different diameters to each other.

The insulating resin may include an epoxy, a polyimide, a liquid crystal polymer, or the like, in a single form or in combined forms, but is not limited thereto.

The body 100 may include a core 110 penetrating through the support substrate 200 and the coil portion 300 to be described later. The core 110 may be formed by filling through-holes of the support substrate 200 with at least a portion of the magnetic composite sheet in processes of laminating and curing the magnetic composite sheet, but a method of forming the core 110 is not limited thereto.

The support substrate 200 may be embedded in the body 100. The support substrate 200 may support the coil portion 300 to be described later.

The support substrate 200 may include an insulating material, for example, a thermosetting insulating resin such as an epoxy resin, a thermoplastic insulating resin such as polyimide, or a photosensitive insulating resin, or the support substrate 200 may include an insulating material in which a reinforcing material such as a glass fiber or an inorganic filler is impregnated with an insulating resin. For example, the support substrate 200 may include an insulating material such as prepreg, Ajinomoto Build-up Film (ABF), FR-4, a bismaleimide triazine (BT) film, a photoimageable dielectric (PID) film, and the like, but are not limited thereto.

The inorganic filler may be at least one or more selected from the group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

When the support substrate 200 is formed of an insulating material including a reinforcing material, the support substrate 200 may provide better rigidity. When the support substrate 200 is formed of an insulating material not containing glass fibers, the support substrate 200 may be advantageous in thinning the overall component. When the support substrate 200 is formed of an insulating material containing a photosensitive insulating resin, the number of processes of forming the coil portion 300 may be reduced. Therefore, it may be advantageous in reducing production costs, and a fine via may be formed.

The support substrate 200 may have a thickness of 10 μm or more and 40 μm or less. When the support substrate 200 has a thickness less than 10 μm, it may be difficult to secure rigidity of the support substrate 200. Therefore, it may be difficult to support the coil portion 300 to be described later in a manufacturing process. When the support substrate 200 has a thickness greater than 40 μm, it may be disadvantageous in thinning the overall component, and it may be disadvantageous in implementing high-capacitance inductance because a volume occupied by the support substrate 200 in the body 100 of the same volume is increased.

One end surface of the support substrate 200 is exposed to an external surface of the body 100. Specifically, referring to FIGS. 1 and 2, the support substrate 200 has one end surface 200A exposed to the first surface 101 of the body 100, the other end surface 200B exposed to the second surface 102 of the body 100, and the other surfaces embedded in the body 100 to not be exposed outwardly of the body 100.

The coil portion 300 may be disposed on the support substrate 200 and may be embedded in the body 100 to exhibit characteristics of the coil component. For example, when the coil component 1000 is used as a power inductor, the coil portion 300 may serve to stabilize the power supply of an electronic device by storing an electric field as a magnetic field and maintaining an output voltage.

The coil portion 300 may include coil patterns 311 and 312, and a via 320. Specifically, based on the directions of FIGS. 1, 2, and 3, a first coil pattern 311 may be disposed on a lower surface of the support substrate 200 facing the sixth surface 106 of the body 100, and a second coil pattern 312 may be disposed on an upper surface of the support substrate 200. The via 320 may penetrate through the support substrate 200 to be in contact with each of the first coil pattern 311 and the second coil pattern 312. In this configuration, the coil portion 300 may serve as a single coil which forms one or more turns about the core 110 overall.

Each of the coil patterns 311 and 312 may be in a planar spiral shape having at least one turn formed about the core 110. As an example, based on the direction of FIG. 2, the first coil pattern 311 may form at least one turn about the core 110 on the lower surface of the support substrate 200.

One end portion of the coil portion 300 is exposed to the external surface of the body 100 together with one end surface of the support substrate 200 to be connected to the external electrodes 400 and 500 to be described later. Specifically, a first lead-out portion 311', one end portion of the coil portion 300, is exposed to the first surface 101 of the body 100 together with one end surface 200A of the support substrate 200 and is in contact with and connected to the first external electrode 400 disposed on the first surface 101 of the body 100. A second lead-out portion 312', the other end portion of the coil portion 300, is exposed to the second surface 102 of the body 100 together with the other end surface 200B of the support substrate 200, and is in contact with and connected to the second external electrode 500 disposed on the second surface 102 of the body 100. The first coil pattern 311 and the first lead-out portion 311' may formed together in the same process with the same material and may be integrated with each other, and the second coil pattern 312 and the second lead-out portion 312' may be formed together in the same process with the same material and may be integrated with each other. Hereinafter, based on the above description, unless the coil patterns 311 and 312 and the lead-out portion 311' and 312' should be distinguished from each other, only the coil patterns 311 and 312 will be described on the assumption that the lead-out portions 311' and 312' are included in the coil patterns 311 and 312.

At least one of the coil patterns 311 and 312 and the via 320 may include at least one conductive layer.

As an example, when the second coil pattern 312 and the via 320 are formed on the other surface of the support substrate 200 by a plating process, each of the second oil pattern 312 and the via 320 may include a seed layer and an electroplating layer. Each of the seed layer and the electroplating layer may have a single-layer structure or a multilayer structure. The electroplating layer having the multilayer structure may have a conformal structure in which one electroplating layer covers the other electroplating layer, or may have a form in which the other electroplating layer is laminated on only one surface of the one electroplating layer. The seed layer of the second coil pattern 312 and the seed layer of the via 320 may be integrated with each other, and thus, there may be no boundary therebetween, but are not limited thereto. The electroplating layer of the second coil pattern 312 and the electroplating layer of the via 320 may be integrated with each other, and thus, there may no boundary therebetween, but are not limited thereto.

As another example, based on FIGS. 2 and 3, the coil portion 300 may be formed by separately forming the first coil pattern 311 disposed on a side of a lower surface of the support substrate 200 and the second coil pattern 312 disposed on aside of an upper surface of the support substrate 200 and laminating the first coil pattern 311 and the second coil pattern 312 on the support substrate 200 in a batch. In this case, the via 320 may include a high-melting-point metal layer and a low-melting-point metal layer having a melting point lower than a melting point of the high-melting-point metal layer. The low-melting-point metal layer may be formed of a metal material including lead (Pb) and/or tin (Sn). At least a portion of the low-melting-point metal layer may be melted due to pressure and temperature during the batch lamination. For this reason, an intermetallic compound layer (IMC layer) may be formed on at least a portion of a boundary between the low-melting-point metal layer and the second coil pattern 312 and a boundary between the low-melting-point metal layer and the high-melting-point metal layer.

For example, the coil patterns 311 and 312 may be formed to protrude from both surfaces of the support substrate 200, as illustrated in FIGS. 2 and 3. As another example, the first coil pattern 311 may be formed to protrude on one surface of the support substrate 200, and the second coil pattern 312 may be embedded in the other surface of the support substrate 200 to expose the one surface to the other surface of the support substrate 200. In this case, a concave portion may be formed on one surface of the second coil pattern 312, so that the other surface of the support substrate 200 and one surface of the second coil pattern 312 may not be located on the same plane. As another example, the second coil pattern 312 may be formed to protrude from the other surface of the support substrate 200, and the first coil pattern 311 may be embedded in one surface of the support substrate 200 to expose one surface of the first coil pattern 311 to one surface of the support substrate 200. In this case, a concave portion may be formed in one surface of the first coil pattern 312 so that one surface of the support substrate 200 and one surface of the first coil pattern 312 may not be located on the same plane.

Each of the coil patterns 311 and 312 and the via 320 may be formed of a conductive material such as copper (Cu), aluminum (Al), silver (Ag), tin (Sn), gold (Au), nickel (Ni), lead (Pb), titanium (Ti), molybdenum (Mo), chromium (Cr), or alloys thereof, but the conductive material is not limited thereto.

The external electrodes 400 and 500 may be spaced apart from each other on the external surface of the body 100 to be respectively connected to both end portions 311' and 312' of the coil portion 300. Specifically, the first external electrode 400 may be disposed on the first surface 101 of the body 100 to be in contact with and connected to first lead-out portion 311' of the coil portion 300 exposed to the first surface 101 of the body 100. The second external electrode 500 may be disposed on the second surface 102 of the body 100 to be in contact with and connected to the second lead-out portion 312' of the coil portion 300 exposed to the second surface 102 of the body 100.

The external electrodes 400 and 500 may be formed of a conductive material such as copper (Cu), aluminum (Al), silver (Ag), tin (Sn), gold (Au), nickel (Ni), lead (Pb), titanium (Ti). The external electrodes 400 and 500 may be formed of a conductive material such as tin (Sn), or alloys thereof, but the conductive material is not limited thereto.

An opening O is formed in each of the external electrodes 400 and 500 to expose at least a portion of each of both end surfaces 200A and 200B of the support substrate 200. For example, an opening O may be formed in the first external electrode 400 to expose at least a portion of one end surface 200A of the support substrate 200, and an opening O may be formed in the second external electrode 500 to expose at least a portion of the other end surface 200B of the support substrate 200.

Conventionally, when a coil component is mounted on a mounting substrate, a bonding member such as a solder, or the like, is disposed between an external electrode of the coil component and a mounting pad of a mounting substrate to connect the coil component and the mounting substrate to each other. To improve the bonding reliability between the coil component and the mounting substrate, the bonding member such as a solder, or the like, is disposed to also be bonded to a region of the external electrode, including a region facing the mounting pad of the external electrode of the coil component, not facing the mounting pad (solder fillet). Due to a thickness of the solder fillet, an area actually occupied by the solder and the coil component in the mounting substrate (an effective mounting area) is increased to be larger than an area of a mounting surface of the coil component. This means that an electrical short-circuit with another component mounted together on the mounting substrate occurs, or a relatively small number of components should be mounted, relative to an area of the same mounting substrate. In this embodiment, the openings O are formed in the first and second external electrodes 400 and 500, such that both end surfaces 200A and 200B of the support substrate 200 may be exposed to an external entity to significantly address the above-mentioned issue. For example, since wettability to the support substrate 200, including a resin, is lower than wettability to the first and second external electrodes 400 and 500 including a metal, a member having low wettability (both end surfaces 200A and 200B of the support substrate 200) may be exposed to an area in which the solder is disposed (an area of the external electrodes 400 and 500 corresponding to the first and second surfaces 101 and 102 of the body 100) to reduce a volume and a thickness of the solder fillet bonded to the external electrodes 400 and 500. Accordingly, in the coil component 1000, an effective mounting area may be reduced during mounting, as compared with a conventional coil component having the same component size. As a result, in the coil component 1000, the possibility of electrical short-circuit with another electronic component mounted together on the mounting substrate may be decreased, and a greater number of electronic components may be mounted on a mounting substrate having the same area.

The first and second surfaces 101 and 102 of the body 100, to which both end surfaces 200A and 200B of the support substrate 200 are exposed, may have a first region, to which both end surfaces 200A and 200B of the support substrate 200 are exposed, and a second region, other than the first region, respectively. As an example, referring to FIG. 4, the second surface 102 of the body 100 may have a first region, to which the other end surface 200B of the support substrate 200 is exposed, and a second region, other than the first region, and the second external electrode 500 may cover an entirety of the second region of the second surface 102 of the body 100. Similarly, referring to FIG. 2, the first surface 101 of the body 100 may have a first region, to which the one end surface 200A of the support substrate 200 is exposed, and a second region, other than the first region, and the first external electrode 400 may cover an entirety of the second region of the first surface 101 of the body 100. In this case, the coil component 1000 may improve the bonding force between the body 100 and the external electrodes 400 and 500 in addition to the above-described effect of this embodiment.

A cross-sectional area of each of both end surfaces 200A and 200B of the support substrate 200 may be larger than a cross-sectional area of the opening O. For example, due to the opening O, the external electrodes 400 and 500 may be in contact with both end surfaces 200A and 200B of the support substrate 200 while exposing both end surfaces 200A and 200B of the support substrate 200 to an external entity. Thus, the external electrodes 400 and 500 may cover a portion of a region of a boundary between both end surfaces 200A and 200B of the support substrate 200, exposed to the first and second surfaces 101 and 102 of the body 100. As a result, moisture or an external substance may be significantly prevented from entering the body 100.

The external electrodes 400 and 500 may be formed to have a multilayer structure. In this case, the opening O penetrates through each of a plurality of layers of the external electrodes 400 and 500 to expose both end surfaces 200A and 200B of the support substrate 200. For example, the first external electrode 400 may include a first layer 10 disposed to be in contact with the first surface 101 of the body 100, a second layer 20 disposed on the first layer 10, and a third layer 30 disposed on the second layer 20, and the opening O may expose the one end surface 200A of the support substrate 200 to an external entity through all of the first to third layers 10, 20, and 30. Each of the first to third layers 10, 20, and 30 may be an electrically conductive layer. The first layer 10 may include copper (Cu), the second layer 20 may include nickel (Ni), and the third layer 30 may include tin (Sn), but materials thereof are not limited thereto. Each of the first to third layers 10, 20, and 30 may be formed by a plating process, but a method of forming each of the first to third layers 10, 20, and 30 is not limited thereto. As another example, the first external electrode 400 may include a resin electrode, including conductive powder particles such as silver (Ag) and a resin, and a nickel/tin (Ni/Sn) plating layer formed on the resin electrode, and the opening O may expose the one end surface 200A of the support substrate 200 to an external entity through the resin electrode and the nickel/tin (Ni/Sn) plating layer. In the above-described examples, outermost layers 30 of the external electrodes 400 and 500 are in contact both end surfaces 200A and 200B of the support substrate 200. Therefore, moisture or an external substance may be significantly prevented from entering a component, as described above.

The insulating layer 600 may be formed on the support substrate 200 and the coil portion 300. The insulating layer 600 may be provided to insulate the coil portion 300 from the body 100, and may include a known insulating material such as parylene. Any insulating material may be used as the insulating material included in the insulating layer 600, and an insulating material is not necessarily limited. The insulating layer 600 may be formed by vapor deposition, or the like, but a method of forming the insulating layer 600 is not limited thereto. The insulating layer 600 may also be formed by laminating an insulating layer on both surfaces of the support substrate 200. In the former case, the insulating layer 600 may be formed to be conformal along surfaces of the support substrate 200 and the coil portion 300. In the latter case, the insulating layer 600 may be formed to fill a space between adjacent turns of the coil patterns 311 and 312. Since the insulating layer 600 is an optional component in this embodiment, the insulating layer 600 may be omitted when the body 100 may secure sufficient insulating resistance under operating conditions of the coil component 1000.

Referring to FIGS. 1 to 5, in the case of this embodiment and a modified embodiment thereof, the coil patterns 311 and 312 are disposed to be horizontal to the sixth surface 106 of the body 100, a mounting surface of the coil components 1000 and 1000' according to this embodiment and the modified embodiment thereof. In one example, the coil patterns 311 and 312 are disposed to be substantially horizontal to the sixth surface 106 of the body 100 in consideration of a process error or margin. In this case, in the support substrate 200, areas of both end surfaces 200A and 200B exposed to the first and second surfaces 101 and 102 of the body 100 may be adjusted. As an example, as illustrated in FIG. 4, the other end surface 200B of the support substrate 200 exposed to the second surface 102 of the body 100 has a dimension 'a1' in a width direction W of the body 100 and a dimension 'b1' in a thickness direction T of the body 100, and the dimension 'a1' may be greater than the dimension 'b1'. As a modified example, as illustrated in FIG. 5, in the other end surface 200B of the support substrate 200 exposed to the second surface 102 of the body 100, a dimension 'a2' in a width direction W of the body 100 may be equal to a width of the body 100. In the former case, areas of both end surfaces 200A and 200B, exposed to the first and second surfaces 101 and 102 of the body 100, may be significantly reduced to improve bonding force between the body 100 and the external electrodes 400 and 500. In the latter case, areas of both end surfaces 200A and 200B, exposed to the first and second surfaces 101 and 102 of the body 100, may be significantly increased to significantly reduce a volume and a thickness of the solder fillet. In the former case and the latter case, dimensions 'b1' and 'b2' of the other end surface 200B of the support substrate 200 in the thickness direction T of the body 100 may each correspond to the above-described thicknesses of the support substrate 200.

In FIGS. 4 and 5, the opening O is illustrated as being formed to have a shape corresponding to the shape of both end surfaces 200A and 200B of the support substrate 200, but this is only illustrative. As another example, a length of the opening O in the width direction W of the body 100 may be changed to be less than a length illustrated in FIG. 5.

Another Example Embodiment and Modified Example

Figure 6:
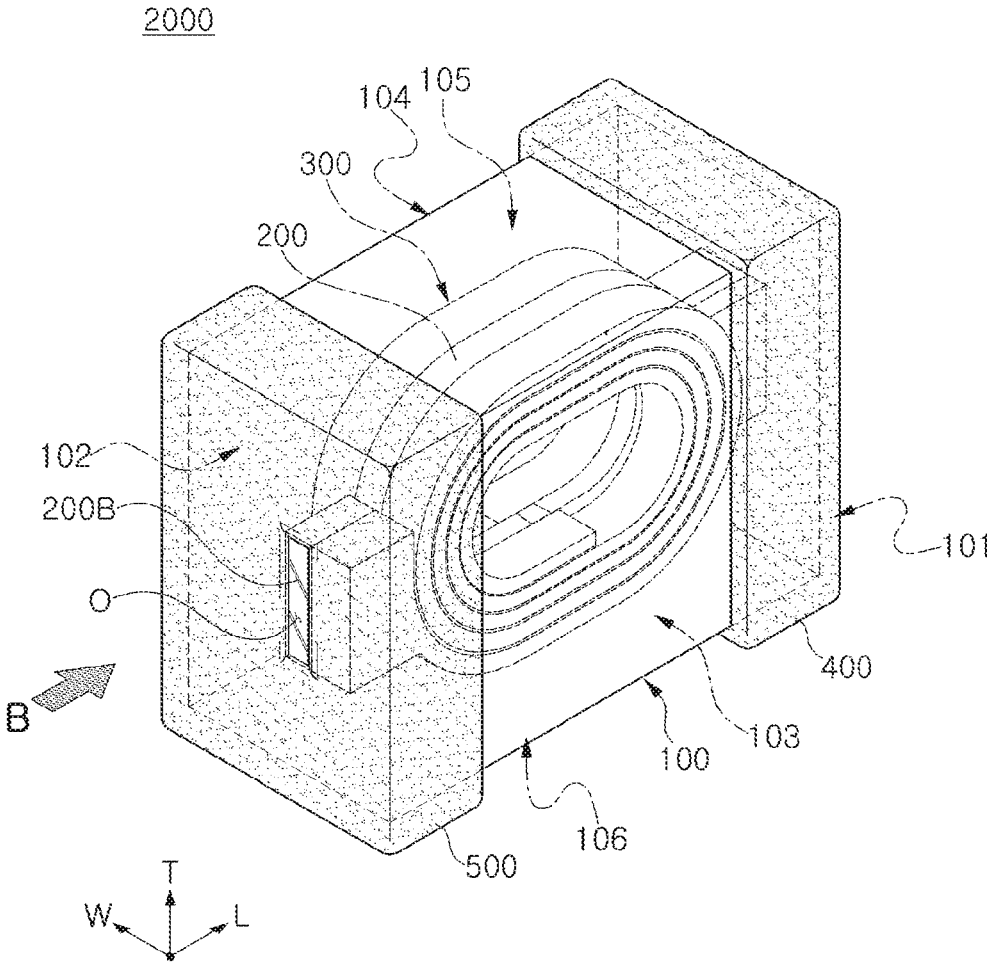
FIG. 6 is a schematic view of a coil component according to another example embodiment of the present disclosure.
Figure 7:
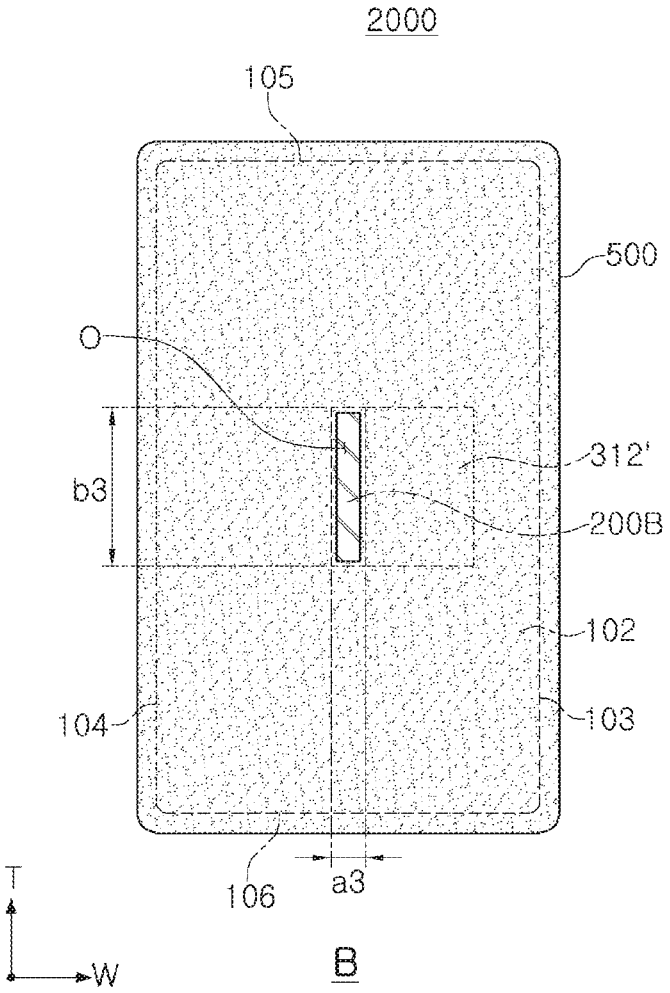
FIG. 7 is a view when viewed in a direction B of FIG. 6.
Figure 8:
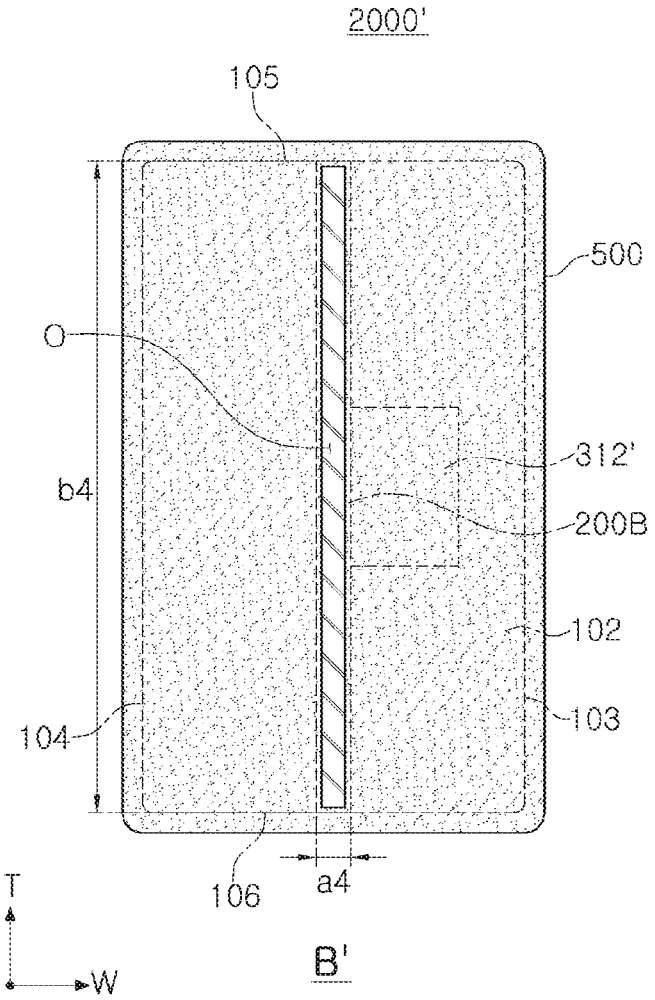
FIG. 8 is a schematic view illustrating a modified example of a coil component according to another example embodiment of the present disclosure, and is a view corresponding to FIG. 7.

FIG. 6 is a schematic view of a coil component according to another example embodiment of the present disclosure. FIG. 7 is a view when viewed in a direction B of FIG. 6. FIG. 8 is a schematic view illustrating a modified example of a coil component according to another example embodiment of the present disclosure, and is a view corresponding to FIG. 7.

Referring to FIGS. 1 to 8, coil components 2000 and 2000' according to this embodiment and a modified embodiment are different in directions of a support substrate 200 and a coil portion 300, disposed in a body 100, from the coil components 1000 and 1000' according to an example embodiment and the modified embodiment. Therefore, this embodiment and the modified embodiment will be described while focusing on only the directions of the support substrate 200 and the coil portion 300 disposed in the body 100, which are different from those of the example embodiment and the modified embodiment. The descriptions of the example embodiment and the modified embodiment may be applied, as it is, to the other components of this embodiment and the modified embodiment.

Referring to FIGS. 6 to 8, in the case of this embodiment and the modified embodiment thereof, coil patterns 311 and 312 are disposed to be perpendicular to a sixth surface 106 of the body 100, a mounting surface of the coil components 2000 and 2000' according to this embodiment and the modified embodiment thereof. In one example, the coil patterns 311 and 312 are disposed to be substantially perpendicular to the sixth surface 106 of the body 100 in consideration of a process error or margin.

The body 100 may be formed such that each of the coil components 2000 and 2000', including external electrodes 400 and 500, has a length of 1.0 mm, a width of 0.6 mm, and a thickness of 0.8 mm. Alternatively, the body 100 may be formed such that each of the coil components 2000 and 2000', including the external electrodes 400 and 500, has a length of 1.6 mm, a width of 0.8 mm, and a thickness of 1.0 mm. However, the ranges of this embodiment and the modified embodiment thereof are not limited to the above-described examples. When the thickness of the body 100 is greater than the width of the body 100, the examples are regarded as being within the ranges of this embodiment and the modified embodiment thereof. In addition, when values are different from the above-mentioned values but are within the range of a process error, they are regarded as being within the scope of the present disclosure.

In the case of this embodiment and the modified embodiment thereof, an area of a sixth surface 106 of the body 100, a mounting surface, may be significantly reduced. In addition, since a core 110 corresponding to a winding axis of a coil portion 300 is disposed to be horizontal to, or substantially horizontal to, the sixth surface 106 of the body 100, the mounting surface, noise induced to a mounting substrate during mounting may be reduced.

In this embodiment and the modified embodiment thereof, in the support substrate 200, areas of both end surfaces 200A and 200B exposed to first and second surfaces 101 and 102 of the body 100 may be adjusted. As an example, as illustrated in FIG. 7, the other end surface 200B of the support substrate 200 exposed to a second surface 102 of the body 100 has a dimension 'a3' in a width direction W of the body 100 and a dimension 'b3' in a thickness direction T of the body 100, and the dimension 'a3' may be less than the dimension 'b3'. As a modified example, as illustrated in FIG. 8, in the other end surface 200B of the support substrate 200 exposed to the second surface 102 of the body 100, a dimension 'b4' in a thickness direction T of the body 100 may be equal to a thickness of the body 100. In the former case, areas of both end surfaces 200A and 200B, exposed to first and second surfaces 101 and 102 of the body 100, may be significantly reduced to improve bonding force between the body 100 and external electrodes 400 and 500. In the latter case, areas of both end surfaces 200A and 200B, exposed to the first and second surfaces 101 and 102 of the body 100, may be significantly increased to significantly reduce a volume and a thickness of a solder fillet. In the former case and the latter case, dimensions 'a3' and 'a4' of the other end surface 200B of the support substrate 200 in the width direction T of the body 100 may each correspond to the above-described thicknesses of the support substrate 200.

As described above, a thickness of a solder fillet connected to an external electrode during mounting of a coil component may be reduced to prevent electrical short-circuit between the coil component and another electronic component mounted together on a mounting board, or the like.

While example embodiments have been shown and described above, it will be apparent to those skilled in the art that modifications and variations could be made without departing from the scope of the present disclosure as defined by the appended claims.

What is claimed is:

1. A coil component comprising:

a body;

a support substrate embedded in the body and having one end surface exposed to an external surface of the body;

a coil portion disposed on the support substrate to be embedded in the body and having one end portion extending from the external surface of the body; and an external electrode disposed on the external surface of the body to be connected to the one end portion of the coil portion, wherein the external electrode has an opening exposing at least a portion of the one end surface of the support substrate, such that the at least portion of the one end surface of the support substrate is a portion of an exterior surface of the coil component, the opening has a close-loop shape in the external electrode, and the at least portion of the one end surface of the support substrate, exposed by the opening, is recessed towards an interior of the body with respect to a portion of the external electrode having the close-loop shape.

2. The coil component of claim 1, wherein the external surface of the body, to which the one end surface of the support substrate is exposed, has a first region, in which the one end surface of the support substrate is exposed, and a second region, other than the first region, and the external electrode covers an entirety of the second region.

3. The coil component of claim 1, wherein the one end surface of the support substrate has a cross-sectional area larger than a cross-sectional area of the opening.

4. The coil component of claim 1, wherein in the one end surface of the support substrate, a dimension in a width direction of the body is greater than a dimension in a thickness direction of the body.

5. The coil component of claim 1, wherein a dimension of the one end surface of the support substrate in a width direction of the body is equal to a width of the body.

6. The coil component of claim 1, wherein in the one end surface of the support substrate, a dimension in a thickness direction of the body is greater than a dimension in a width direction of the body.

7. The coil component of claim 1, wherein a dimension of the one end of the support substrate in a thickness direction of the body is equal to a thickness of the body.

8. A coil component comprising:

a body;

a support substrate embedded in the body and having one end surface exposed to an external surface of the body;

a coil portion disposed on the support substrate to be embedded in the body and having one end portion extending from the external surface of the body; and an external electrode connected to the one end portion of the coil portion and including a plurality of layers, sequentially disposed on the external surface of the body, the external electrode has an opening exposing at least a portion of the one end surface of the support substrate, and the opening has a close-loop shape in the external electrode and penetrates through each of the plurality of layers of the external electrode.

9. The coil component of claim 8, wherein an outermost layer of the plurality of layers of the external electrode is in contact with the one end surface of the support substrate.

10. The coil component of claim 8, wherein an outermost layer of the plurality of layers of the external electrode includes tin (Sn).

11. A coil component comprising:

a body including first and second surfaces opposing each other in a first direction of the body, third and fourth surfaces connected to the first and second surfaces and opposing each other in a second direction of the body, and fifth and sixth surfaces connected to the first to fourth surfaces and opposing each other in a third direction of the body;

a support substrate embedded in the body and having one end surface exposed to an external surface of the body;

a coil portion disposed on the support substrate to be embedded in the body and having one end portion extending from the first surface of the body;

a first conductive layer being in contact with the body and having a first opening exposing at least a portion of the one end surface of the support substrate; and one or more conductive layers disposed on the first conductive layer, wherein the first conductive layer extends from the first surface onto one or more of the third to sixth surfaces, and the one or more conductive layers each have an opening exposing the portion of the one end surface of the support substrate exposed by the first opening of the first conductive layer.

12. The coil component of claim 11, wherein an outermost layer of the one or more conductive layers includes tin (Sn).

13. The coil component of claim 11, wherein an outermost layer of the one or more conductive layers is in contact with the support substrate.

14. The coil component of claim 11, wherein the one or more conductive layers each cover an entirety of the first conductive layer.

15. The coil component of claim 11, wherein the first conductive layer is in direct contact with the body.

* * * * *